US007090525B1

(12) United States Patent
Morana

(10) Patent No.: US 7,090,525 B1
(45) Date of Patent: Aug. 15, 2006

(54) ELECTRICAL CONNECTOR INCLUDING SNAP-IN LANYARD

(75) Inventor: Francis P. Morana, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/054,592

(22) Filed: Feb. 9, 2005

(51) Int. Cl.
*H01R 13/627* (2006.01)

(52) U.S. Cl. ..... 439/352; 439/257

(58) Field of Classification Search ..... 439/352, 439/258, 357
See application file for complete search history.

(56) References Cited

U.S. PATENT DOCUMENTS

| | | | | |
|---|---|---|---|---|
| 5,080,600 | A | 1/1992 | Baker et al. | |
| 5,564,939 | A * | 10/1996 | Maitani et al. | 439/352 |
| 5,653,606 | A | 8/1997 | Chrysostomou | |
| 5,951,316 | A | 9/1999 | Kawano et al. | |
| 6,447,170 | B1 | 9/2002 | Takahashi et al. | |
| 6,570,768 | B1 | 5/2003 | Medina | |
| 6,592,391 | B1 * | 7/2003 | Wu | 439/352 |
| 6,641,425 | B1 * | 11/2003 | Wu | 439/352 |
| 6,659,790 | B1 * | 12/2003 | Wu | 439/352 |
| 6,702,603 | B1 * | 3/2004 | Wu | 439/352 |
| 6,739,904 | B1 | 5/2004 | Wu | 439/497 |
| 6,746,158 | B1 | 6/2004 | Merrick | |
| 6,866,533 | B1 | 3/2005 | Wu | 439/352 |
| 6,887,091 | B1 * | 5/2005 | Wu | 439/352 |
| 7,008,253 | B1 * | 3/2006 | Szczesny | 439/352 |
| 2004/0048510 | A1 * | 3/2004 | Olson et al. | 439/381 |

OTHER PUBLICATIONS

SFF Committee (ftp.seagate.com/sff), SFF-8470 Specification for Shielded High Speed Serial Multilane Copper Connector;Rev 2.9, Sep. 9, 2003, pp. 1-51.

* cited by examiner

*Primary Examiner*—Gary F. Paumen
*Assistant Examiner*—Larisa Tsukerman

(57) ABSTRACT

A connector for electrical, telephonic and/or data transmission for selective engagement with a complementary receptacle, is provided. The connector includes a housing defining a pair of channels extending into slots at a rear surface of the housing and capable of supporting a contact member therein. The connector further includes a lanyard operatively associated with the housing. The lanyard includes locking and releasing arms slidably disposed within each channel of the housing, and an extracting tab selectively engageable with each locking and releasing arm. Additionally, the extracting tab includes a pair of legs insertable into a respective slot at the back of the housing. Each leg includes an engaging member projecting from an inner surface thereof for engaging a respective aperture formed in the slider. Desirably, the extracting tab is snap-fit connected to each locking and releasing arm.

22 Claims, 5 Drawing Sheets

ELECTRICAL CONNECTOR INCLUDING SNAP-IN LANYARD

BACKGROUND

1. Technical Field

The present disclosure relates to electrical, telephonic and/or data connectors and, more particularly, to electrical connectors including snap-in lanyards capable of locking and unlocking the electrical connector to a corresponding receptacle.

2. Background of Related Art

Various latching mechanisms and lanyards have been developed and incorporated into electrical, data and/or telephonic cable connectors or plugs for mechanically connecting the plug to a corresponding complementary receptacle. Typically, in order to release the plug from the receptacle an individual must squeeze, depress or otherwise manipulate the latching mechanism in order to release the plug from the receptacle.

However, in densely packed arrays of receptacles, manipulation of the latching mechanism, for the plugs connected to substantially the centrally located receptacles of the array, is greatly hindered and impaired as compared to manipulation of the latching mechanisms for plugs located around the perimeter of the array. Typically, in order to manipulate the latching mechanism and unplug the centrally located plugs from the receptacle array, it is not uncommon to have to first unplug and/or remove the perimetral plugs from the perimetral array in order to gain sufficient access to the latching mechanisms of the centrally located plugs.

Accordingly, the need exists for latching mechanisms and/or snap-in lanyards which facilitate connection and disconnection of plugs into/from corresponding receptacles.

SUMMARY

The present disclosure relates generally to electrical, telephonic and/or data connectors. More particularly, the present disclosure relates to electrical connectors including snap-in lanyards capable of locking and unlocking the electrical connector to a corresponding receptacle.

In accordance with an aspect of the present disclosure, a connector for electrical, telephonic and/or data transmission for selective engagement with a complementary receptacle, is provided. The connector includes a housing defining a pair of channels extending into slots at a rear surface of the housing and capable of supporting a contact member therein. The connector further includes a lanyard operatively associated with the housing.

The lanyard includes locking and releasing arms slidably disposed within each channel of the housing, and an extracting tab selectively engageable with each locking and releasing arm. The extracting tab desirably extends from the rear surface of the housing when connected to the housing. Additionally, the extracting tab includes a pair of legs insertable into a respective slot at the back of the housing. Each leg includes an engaging member projecting from an inner surface thereof for engaging a respective aperture formed in the slider. Desirably, the extracting tab is snap-fit connected to each locking and releasing arm.

In one embodiment, it is envisioned that each locking and releasing arm includes a slider defining a distal aperture and a proximal aperture formed therein, and a locking finger operatively connected to the slider. Desirably, each locking finger extends through the distal aperture of a respective slider. It is contemplated that each locking finger may include an in-turned tab provided at a distal end thereof. Additionally, each locking finger may include a hook formed at a proximal end thereof, wherein each hook is engageable with a respective slot defined in the housing.

In use, it is envisioned that movement of each slider in a proximal direction will results in displacement of in-turned tabs of locking fingers in an outward direction relative to a longitudinal axis of the housing.

Desirably, the proximal aperture of each slider is configured and dimensioned to receive an engaging member of a respective leg of the extracting tab. It is envisioned that the engaging members projecting from the legs of the extracting tab are wedge-shaped. Desirably, a proximal tip of each slider is sloped inwardly to facilitate engagement of the legs of the extracting tab to the locking and releasing arms.

According to another aspect of the present disclosure, a lanyard for a connector of the electrical, telephonic and data type having a housing and a contact member supported in the housing, is provided. The lanyard includes a pair of locking and releasing arms slidably disposed within respective channels defined in the housing; and an extracting tab selectively engageable with each locking and releasing arm. The extracting tab may extend from a rear surface of the housing when connected thereto. The extracting tab includes a pair of legs each having an engaging member projecting from an inner surface thereof for engaging a respective aperture formed in the slider.

For a better understanding of the present invention and to show how it may be carried into effect, reference will now be made by way of example to the accompanying drawings.

DETAILED DESCRIPTION OF THE DRAWINGS

Figure 10:
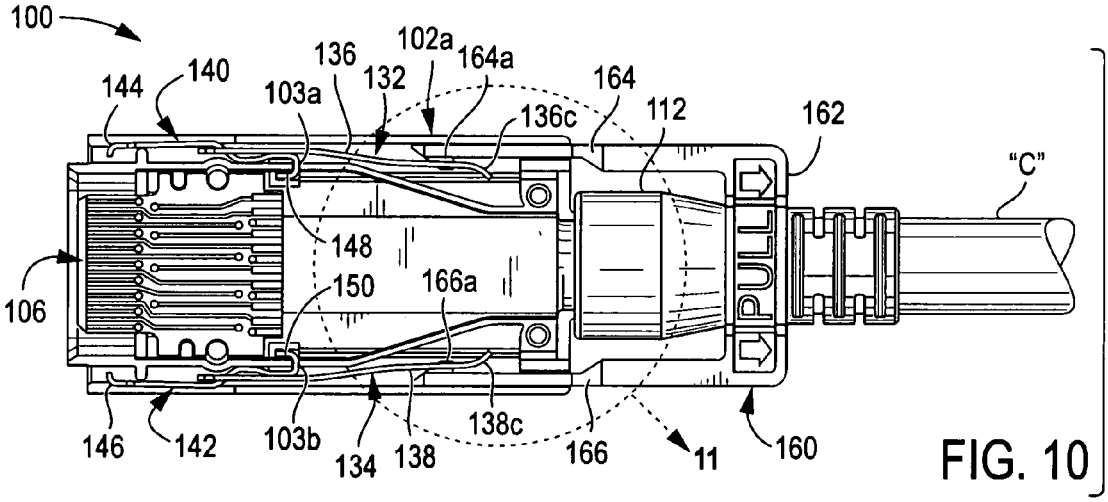
Figure 11:
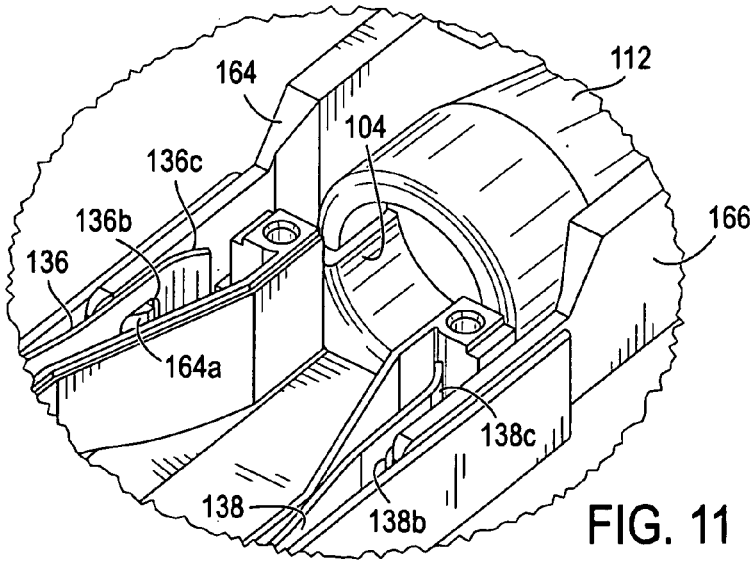

FIG. 10 is a top plan view of the electrical connector of FIGS. 1–7, with the second half-section removed therefrom, illustrating the electrical connector following connection of the latch portion of the snap-in lanyard thereto; and FIG. 11 is an enlarged perspective view of the indicated area of detail of FIG. 10, illustrating the connection of the latch portion of the snap-in lanyard to the electrical connector.

DETAILED DESCRIPTION OF THE EMBODIMENTS

Embodiments of the presently disclosed connector will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1–7, a connector (e.g., electrical connector, data connector, telephonic connector, etc.), to selective connection to a complementary receptacle (not shown), is generally designated as 100. Connector 100 includes a housing 102 for holding an end of a cable "C" therein, and a lanyard 130 for facilitating release and/or delatching of housing 102 from the corresponding receptacle.

Housing 102 includes a first or bottom half-section 102*a* and a selectively removable second or top half-section 102*b*. Housing 102 further includes a cable engaging member 104 extending from a rear of proximal surface 102*c* thereof.

Connector 100 further includes a contact member 106 supported in housing 102. Contact member 106 includes a forward or distal portion 106*a* desirably extending from a forward or distal end of housing 102, and a rearward or proximal portion 106*b* extending into housing 102. Contact member 106 includes a plurality of contact leads 108 extending from the forward portion 106*a* to the rearward portion 106*b* thereof.

Connector 100 may further include a ferrule 110 for securing cable "C" to cable engaging member 104. Connector 100 may further include a strain relief boot 112 which is configured and dimensioned for placement over cable "C". Strain relief boot 112 includes a head portion 112*a* configured and dimensioned to over-lie and/or otherwise engage ferrule 110 and/or cable engaging member 104.

As seen in FIGS. 1–4, lanyard 130 is a multi-part element including a pair of locking and releasing arms 132, 134, and an extracting tab 160 selectively connectable to each of the locking and releasing arms 132, 134. Locking and release arms 132, 134 are slidably disposed within respective channels 114, 116 formed in housing 102. Desirably, channels 114, 116 are formed along a left and a right side of housing 102.

Each locking and releasing arm 132, 134 includes a respective slider 136, 138, and a respective locking finger 140, 142 operatively connected to a distal or forward end of each slider 136, 138. Each slider 136, 138 includes a distal or forward aperture 136*a*, 138*b* through which a portion of each respective locking finger 140, 142 passes, as will be described in greater detail below. Additionally, each slider 136, 136 includes a proximal or rearward aperture 136*b*, 138*b* for engaging (e.g., snap-fit engaging) wedges 164*a*, 166*a* extending from legs 164, 166 of extracting tab 160, as will be described in greater detail below.

Figure 1:
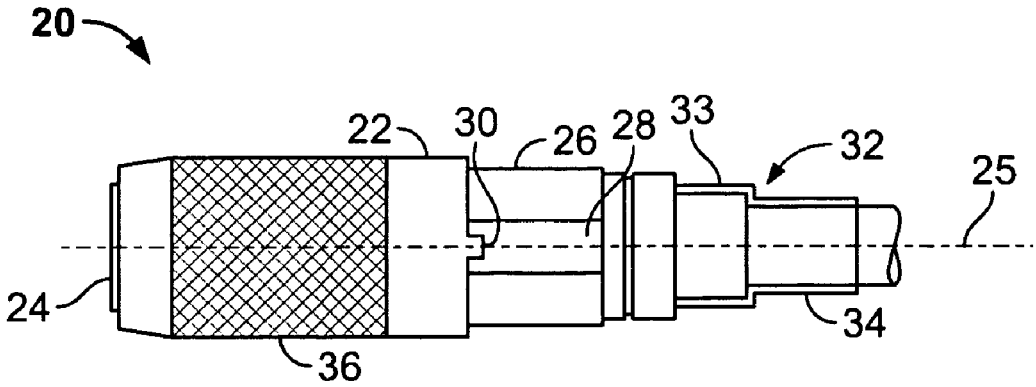
FIG. 1 is a perspective view of an electrical connector including a snap-in lanyard, in accordance with an embodiment of the present disclosure.
Figure 2:
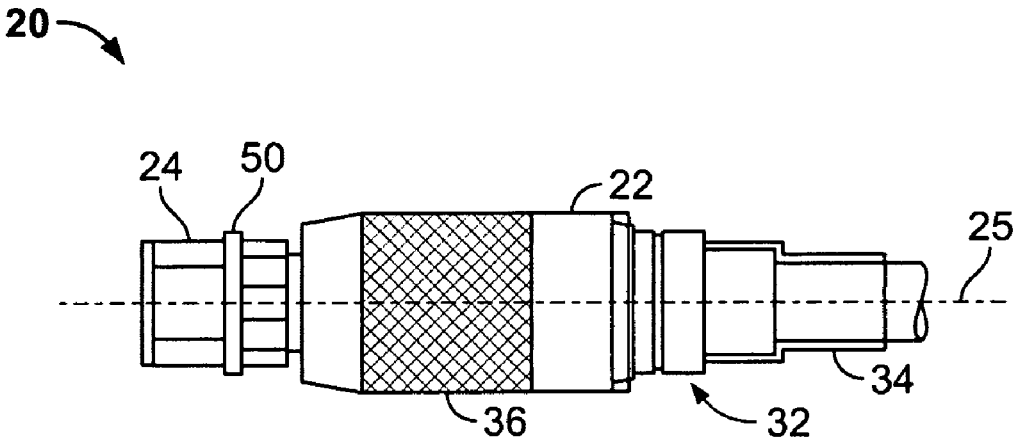
FIG. 2 is a perspective view, with parts separated, of the electrical connector of FIG. 1.

As seen in FIG. 2, each locking finger 140, 142 includes a distal or forward portion 140*a*, 142*a*, and a proximal or rearward portion 140*b*, 142*b*. Each distal portion 140*a*, 142*a* of locking fingers 140, 142 includes an in-turned tab 144, 146, respectively. Rearward portions 140*b*, 142*b* of locking fingers 140, 142 extend through forward apertures 136*a*, 138*a* of respective sliders 136, 138, and terminate in a respective hook 148, 150. Desirably, as seen in FIGS. 2 and 8–10, hooks 148, 150 are disposed in respective slots 103*a*, 103*b* defined in housing 102.

Each slider 136, 138 includes a distal or forward aperture 136*a*, 138*a* through which the proximal or rearward portion 140*b*, 142*b*, in particular, the hooks 148, 150 of respective locking fingers 140, 142 extend. Each slider 136, 138 includes a respective proximal or rear aperture 136*b*, 138*b* formed therein for selectively engaging wedges 164*a*, 166*a* of legs 164, 166 of extracting tabs 160. Desirably, each slider 136, 138 includes an inward angled or sloped proximal or rear tip 136*c*, 138*c* for facilitating insertion and/or connection of extracting tab 160 thereto.

As seen in FIGS. 1, 2 and 7–11, extracting tab 160 includes a backspan 162, and opposed first and second legs 164, 166 extending from backspan 162. Each leg 164, 166 includes an engaging member in the form of a wedge 164*a*, 166*a* projecting from an inner surface thereof. Desirably, wedges 164*a*, 166*a* are configured and dimensioned to selectively enter and/or engage a respective proximal or rearward aperture 136*b*, 138*b* of sliders 136, 138 when extracting tab 160 is connected to housing 102.

Desirably, in an embodiment, lanyard 130 may be "keyed" or include a polarization element in order to ensure that the assembler connects extracting tab 160 to housing 102 in a proper orientation and to prevent the assembler from connecting extracting tab 160 to housing 102 in an upside down orientation.

Figure 3:
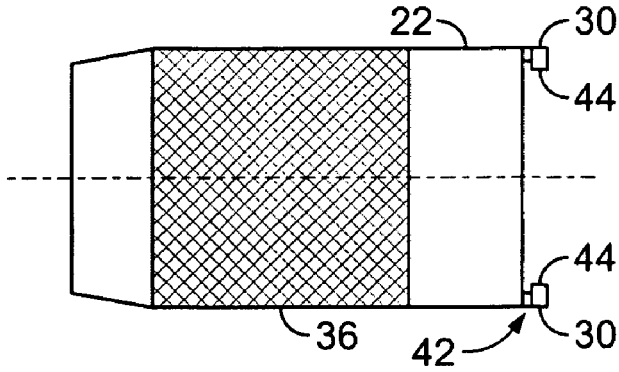
FIG. 3 is a perspective view of a first half-section of the electrical connector of FIGS. 1 and 2, illustrating a first or locking portion of the snap-in lanyard spaced therefrom.
Figure 4:
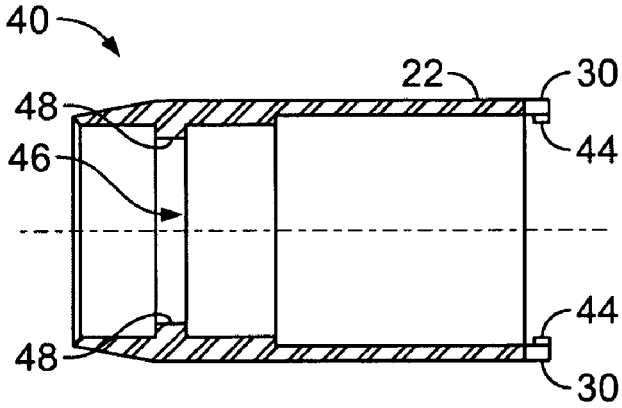
FIG. 4 is a perspective view of the first half-section of the electrical connector of FIG. 3, illustrating the first or locking portion of the snap-in lanyard operatively associated therewith.

Turning now to FIGS. 3–10, a method of assembling connector 100 is provided. As seen in FIG. 3, locking and releasing arms 132, 134 are inserted into respective channels 114, 116 defines in first half-section 102*a* of housing 102. Desirably, when locking and releasing arms 132, 134 are positioned within respective channels 114, 116, hooks 148, 150 thereof are inserted into respective slots 103*a*, 103*b*. Either prior to or following positioning of locking and releasing arms 132, 134 into respective channels 114, 116, as seen in FIG. 4, cable "C" is operatively connected to housing 102 (i.e., cable "C" is electrically connected to contact member 106). As is typical in the art, strain relief boot 112, and optionally ferrule 110, are slid onto cable "C" prior to connection of cable "C" to housing 102.

Figure 5:
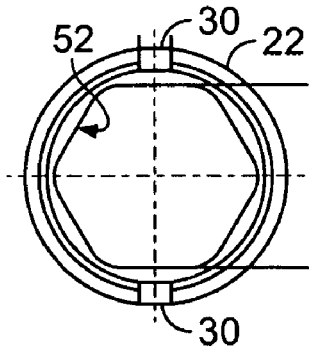
FIG. 5 is a perspective view of the electrical connector of FIGS. 1–4, illustrating the second half-section operatively connected to the first half-section.
Figure 6:
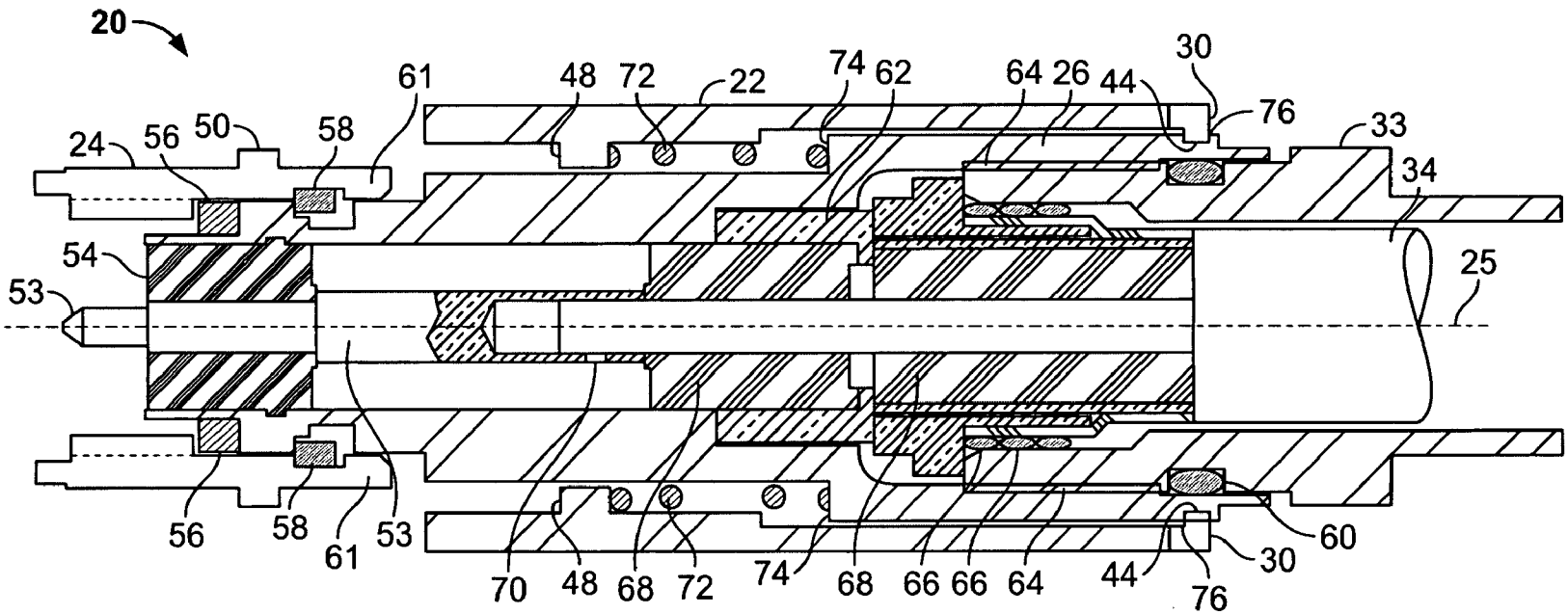
FIG. 6 is a perspective view of the electrical connector of FIG. 5, illustrating a strain relief boot operatively connected to a stem of the first and second half-sections.
Figure 7:
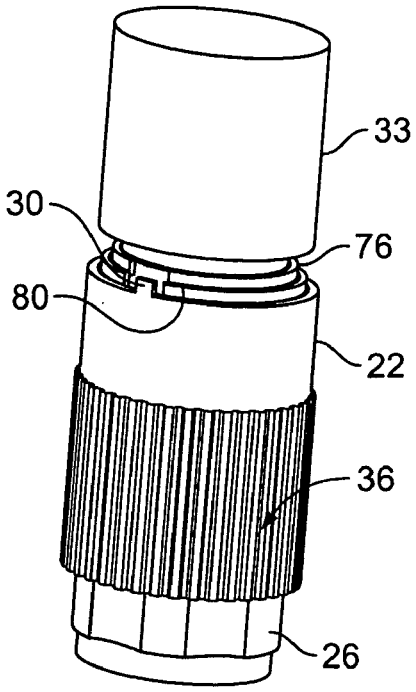
FIG. 7 is a perspective view of the electrical connector of FIG. 6, illustrating a second or latch portion of the snap-in lanyard operative connected thereto.

As seen in FIG. 5, second half-section 102*b* of housing 102 is connected to and/or secured to first half-section 102*a* by means of screws of the like (not shown). As seen in FIG. 6, with first half-section 102*a* and second half-section 102*b* secured to one another, strain relief boot 112 may be slid along cable "C" to engage cable engaging member 104. Finally, as seen in FIGS. 7–10, either prior to or following insertion of connector 100 into a complementary receptacle, extracting tab 160 is operatively connected thereto.

Figure 8:
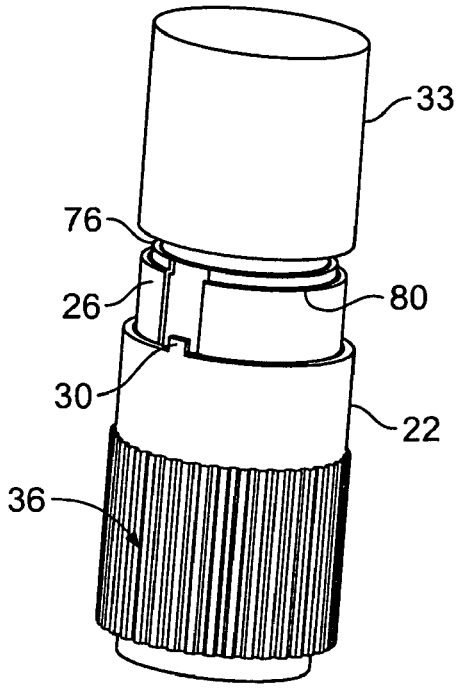
FIG. 8 is a top plan view of the electrical connector of FIGS. 1–7, with the second half-section removed therefrom, illustrating the electrical connector prior to the connection of the latch portion of the snap-in lanyard thereto.
Figure 9:
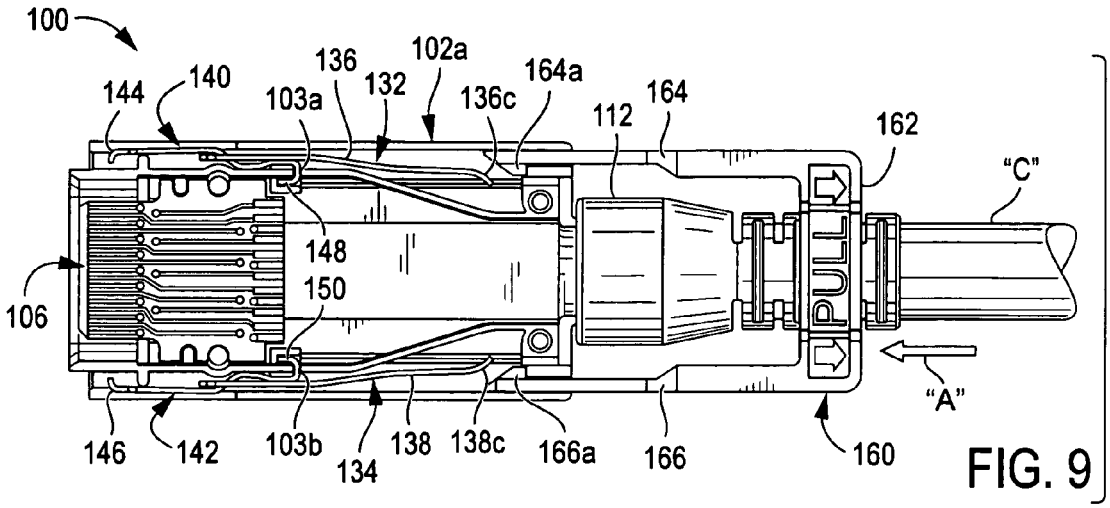
FIG. 9 is a top plan view of the electrical connector of FIGS. 1–7, with the second half-section removed therefrom, illustrating the electrical connector during connection of the latch portion of the snap-in lanyard thereto.

With reference to FIGS. 8–11, a detailed discussion of the connection of extracting tab 160 to housing 102 is provided. As seen in FIG. 8, following connection of cable "C" to housing 102 and connection of strain relief boot 112 to cable engaging member 104, legs 164 and 166 of extracting tab 160 are aligned with respective slots 105*a*, 105*b* provided in rear or proximal surface 102*c* of housing 102. Desirably, slots 105*a*, 105*b* are in registration with channels 114, 116 of housing 102. With legs 164, 166 aligned with respective slots 105*a*, 105*b*, as seen in FIG. 9 extracting tab 160 is advanced in a distal or forward direction, as indicated by arrow "A", thus inserting legs 164, 166 into slots 105*a*, 105*b* and channels 114, 116.

As seen in FIGS. 10 and 11, as extracting tab 160 is further advanced into slots 105*a*, 105*b* of housing 102, wedges 164*a*, 166*a* of legs 164, 166 contact sloped tips 136*c*, 138*c* of respective sliders 136, 138 causing sloped tips 136*c*, 138*c* to deflect inward until wedges 164*a*, 166*a* are in registration with proximal or rear apertures 136*b*, 138*b* of sliders 136, 138 at which time sloped tips 136*c*, 138*c* return to their un-deflected condition. In other words, legs 164, 166 of extracting tab 160 engage respective sliders 136, 138 in a snap-fit type engagement. Desirably, the engagement of extracting tab 160 to sliders 136, 138 takes place at least substantially entirely within housing 102.

In use, in order to unplug, delatch and/or disengage connector 100 from a corresponding complementary receptacle, the user simply needs to pull on extracting tab 160 in a rearward direction, which in turn causes wedges 164*a*, 166*a* of legs 164, 166 to pull on sliders 136, 138. Since hooks 148, 150 of locking fingers 140, 142 are positioned within slots 148, 150 and thus preventing from moving in a rearward direction, as sliders 136, 138 are pulled in a rearward direction distal portion 140*a*, 142*a* of locking fingers 140, 142 are cammed in an outward direction (i.e., in a direction away from a longitudinal axis of housing 102) thus causing in-turned tabs 144, 146 to disengage a complementary element provided in or on the receptacle (not shown).

It is to be understood that the foregoing description is merely a disclosure of particular embodiments and is no way intended to limit the scope of the invention. Other possible modifications will be apparent to those skilled in the art and all modifications will be apparent to those in the art and all modifications are to be defined by the following claims.

What is claimed is:

1. A connector for electrical, telephonic and/or data transmission for selective engagement with a complementary receptacle, the connector comprising:

a housing defining a pair of channels, the channels extending into slots at a rear surface of the housing, the housing including a contact member supported therein; and a lanyard operatively associated with the housing, the lanyard including:

locking and releasing arms slidably disposed within each channel of the housing; and an extracting tab selectively engageable with each locking and releasing arm, wherein the extracting tab extends from the rear surface of the housing when connected to the housing, and wherein the extracting tab includes a pair of legs insertable into a respective slot at the rear of the housing, each leg having an engaging member projecting from an inner surface thereof for engaging a respective aperture formed in locking and releasing arms.

2. The connector according to claim 1, wherein the extracting tab is snap-fit connected to each locking and releasing arm.

3. The connector according to claim 2, wherein each locking and releasing arm includes:

a slider defining a distal aperture and a proximal aperture formed therein; and a locking finger operatively connected to the slider.

4. The connector according to claim 3, wherein each locking finger extends through the distal aperture of a respective slider.

5. The connector according to claim 4, wherein each locking finger includes an in-turned tab provided at a distal end thereof.

6. The connector according to claim 5, wherein each locking finger includes a hook formed at a proximal end thereof, wherein each hook is engageable with a respective slot defined in the housing.

7. The connector according to claim 5, wherein movement of each slider in a proximal direction results in displacement of in-turned tabs of locking fingers in an outward direction relative to a longitudinal axis of the housing.

8. The connector according to claim 7, wherein the proximal aperture of each slider is configured and dimensioned to receive an engaging member of a respective leg of the extracting tab.

9. The connector according to claim 8, wherein the engaging members projecting from the legs of the extracting tab are wedge-shaped.

10. The connector according to claim 9, wherein a proximal tip of each slider is sloped inward.

11. The connector according to claim 1, wherein the extracting tab is keyed for enabling proper orientation of the extracting tab during connection to the housing.

12. A lanyard for a connector of the electrical, telephonic and data type having a housing and a contact member supported in the housing, the lanyard comprising:

a pair of locking and releasing arms slidably disposed within respective channels defined in the housing; and an extracting tab selectively engageable with each locking and releasing arm, wherein the extracting tab extends from a rear surface of the housing when connected thereto, and wherein the extracting tab includes a pair of legs each having an engaging member projecting from an inner surface thereof for engaging a respective aperture formed in the locking and releasing arms.

13. The lanyard according to claim 12, wherein the extracting tab is snap-fit connected to each locking and releasing arm.

14. The lanyard according to claim 13, wherein each locking and releasing arm includes:

a slider defining a distal aperture and a proximal aperture formed therein; and a locking finger operatively connected to the slider.

15. The lanyard according to claim 14, wherein each locking finger extends through the distal aperture of a respective slider.

16. The lanyard according to claim 15, wherein each locking finger includes an in-turned tab provided at a distal end thereof.

17. The lanyard according to claim 16, wherein each locking finger includes a hook formed at a proximal end thereof, wherein each hook is engageable with a respective slot defined in the housing of the connector.

18. The lanyard according to claim 16, wherein movement of each slider in a proximal direction results in displacement of in-turned tabs of locking fingers in an outward direction relative to a longitudinal axis of the housing.

19. The lanyard according to claim 18, wherein the proximal aperture of each slider is configured and dimensioned to receive an engaging member of a respective leg of the extracting tab.

20. The lanyard according to claim 19, wherein the engaging members projecting from the legs of the extracting tab are wedge-shaped.

21. The lanyard according to claim 20, wherein a proximal tip of each slider is sloped inward.

22. The lanyard according to claim 12, wherein the extracting tab is keyed for enabling proper orientation of the extracting tab during connection to the housing.

* * * * *

UNITED STATES PATENT AND TRADEMARK OFFICE

CERTIFICATE OF CORRECTION

PATENT NO. : 7,090,525 B1 
APPLICATION NO. : 11/054592
DATED : August 15, 2006
INVENTOR(S) : Francis P. Morana It is certified that error appears in the above-identified patent and that said Letters Patent is hereby corrected as shown below:

The title page showing the illustrative figure should be deleted and substitute with the attached title page.

Drawings,
Delete Figs. 1-11 and substitute the following Figs. 1-11:

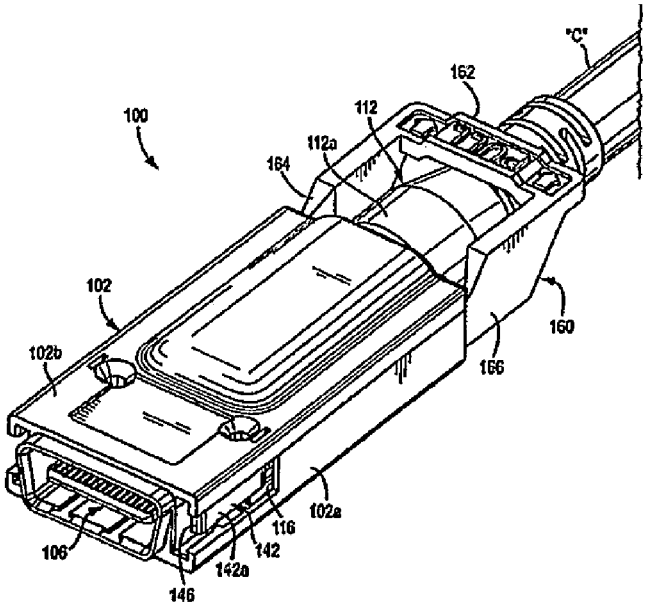

FIG. 1

UNITED STATES PATENT AND TRADEMARK OFFICE

CERTIFICATE OF CORRECTION

PATENT NO. : 7,090,525 B1
APPLICATION NO. : 11/054592
DATED : August 15, 2006
INVENTOR(S) : Francis P. Morana It is certified that error appears in the above-identified patent and that said Letters Patent is hereby corrected as shown below:

Drawings (cont'd),

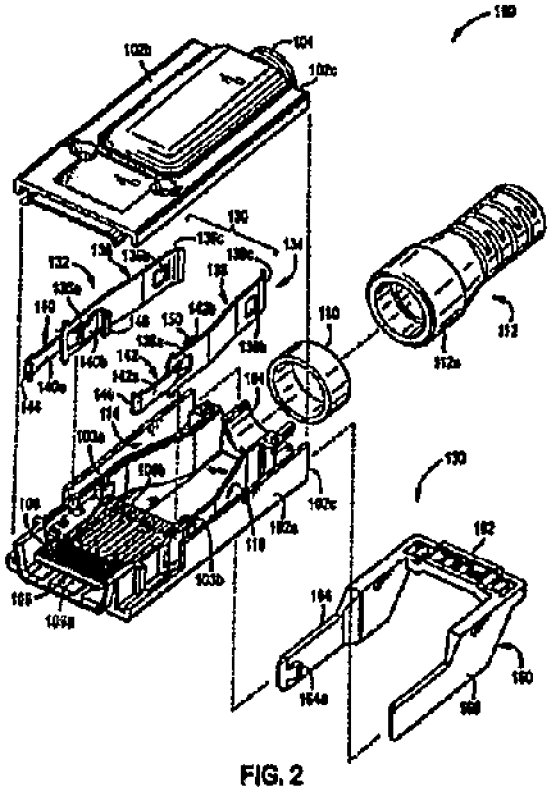

FIG. 2

UNITED STATES PATENT AND TRADEMARK OFFICE

CERTIFICATE OF CORRECTION

PATENT NO. : 7,090,525 B1
APPLICATION NO. : 11/054592
DATED : August 15, 2006
INVENTOR(S) : Francis P. Morana It is certified that error appears in the above-identified patent and that said Letters Patent is hereby corrected as shown below:

Drawings (cont'd),

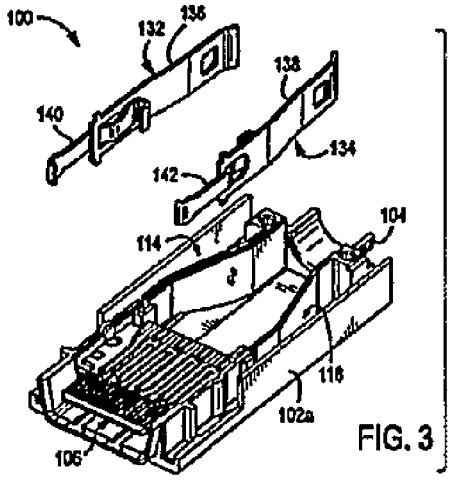

FIG. 3

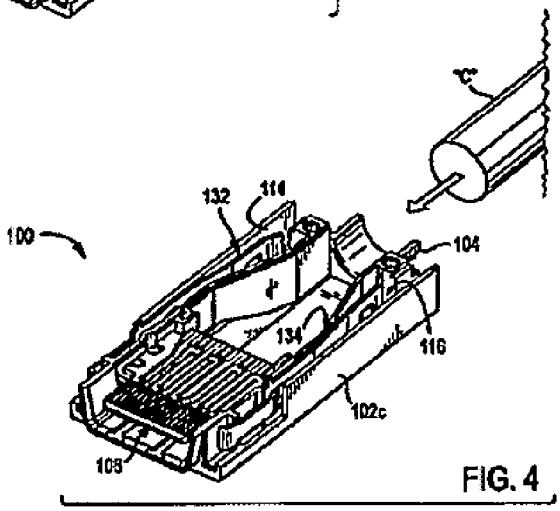

FIG. 4

UNITED STATES PATENT AND TRADEMARK OFFICE

CERTIFICATE OF CORRECTION

PATENT NO. : 7,090,525 B1
APPLICATION NO. : 11/054592
DATED : August 15, 2006
INVENTOR(S) : Francis P. Morana It is certified that error appears in the above-identified patent and that said Letters Patent is hereby corrected as shown below:

Drawings (cont'd),

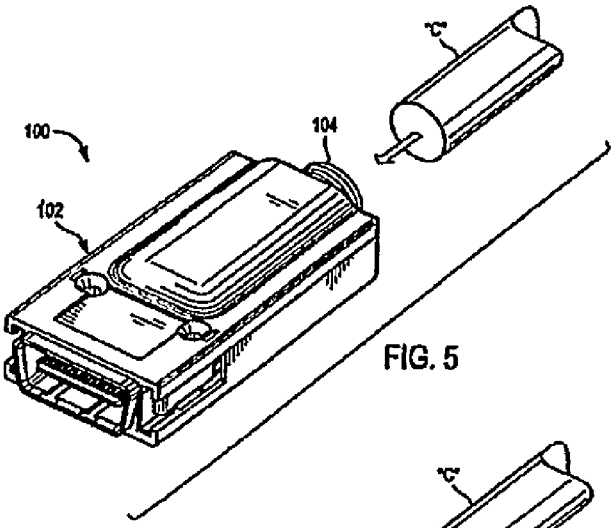

FIG. 5

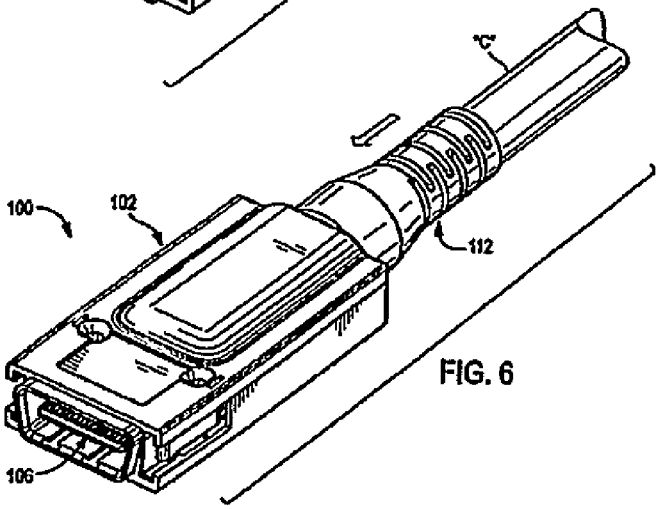

FIG. 6

UNITED STATES PATENT AND TRADEMARK OFFICE

CERTIFICATE OF CORRECTION

PATENT NO. : 7,090,525 B1 
APPLICATION NO. : 11/054592
DATED : August 15, 2006
INVENTOR(S) : Francis P. Morana It is certified that error appears in the above-identified patent and that said Letters Patent is hereby corrected as shown below:

Drawings (cont'd),

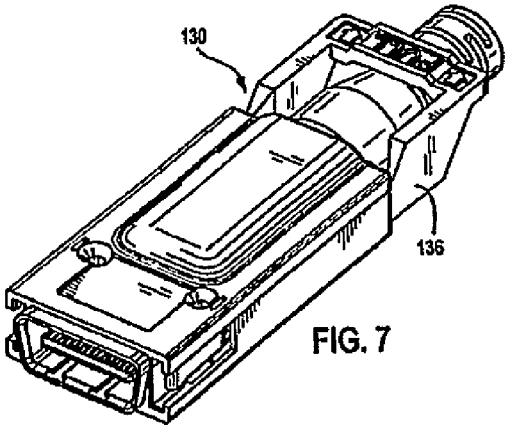

FIG. 7

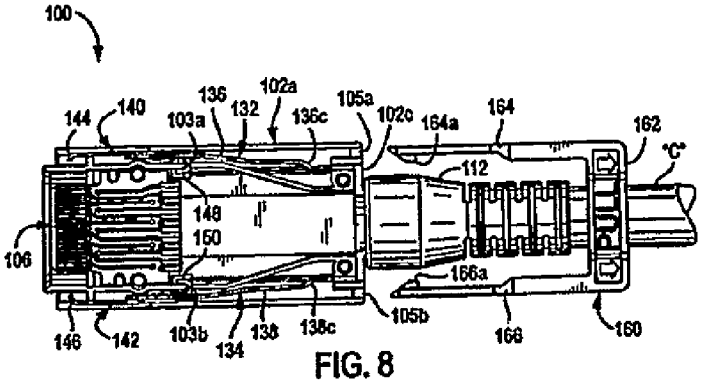

FIG. 8

UNITED STATES PATENT AND TRADEMARK OFFICE

CERTIFICATE OF CORRECTION

PATENT NO. : 7,090,525 B1 
APPLICATION NO. : 11/054592
DATED : August 15, 2006
INVENTOR(S) : Francis P. Morana It is certified that error appears in the above-identified patent and that said Letters Patent is hereby corrected as shown below:

Drawings (cont'd),

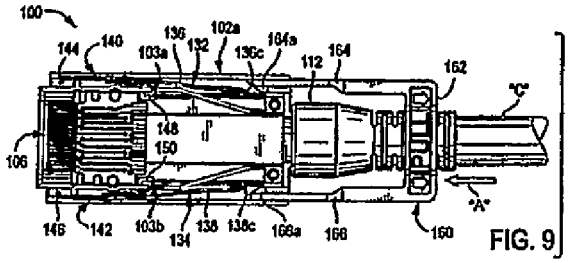

FIG. 9

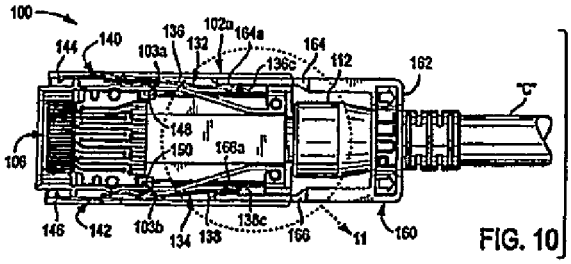

FIG. 10

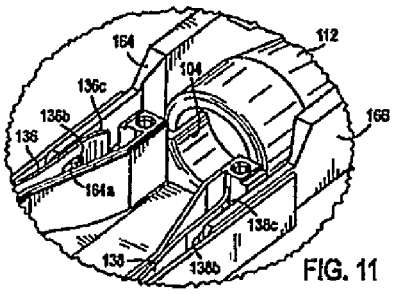

FIG. 11

Signed and Sealed this

Fourth Day of September, 2007

JON W. DUDAS
*Director of the United States Patent and Trademark Office*

(12) United States Patent
Morana

(10) Patent No.: US 7,090,525 B1
(45) Date of Patent: Aug. 15, 2006

(54) ELECTRICAL CONNECTOR INCLUDING SNAP-IN LANYARD

(75) Inventor: Francis P. Morana, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/054,592

(22) Filed: Feb. 9, 2005

(51) Int. Cl.
*H01R 13/627* (2006.01)

(52) U.S. Cl. ..... 439/352; 439/257

(58) Field of Classification Search ..... 439/352, 439/258, 357

See application file for complete search history.

(56) References Cited

U.S. PATENT DOCUMENTS

| | | | | |
|---|---|---|---|---|
| 5,080,600 | A | 1/1992 | Baker et al. | |
| 5,564,939 | A * | 10/1996 | Mutani et al. | 439/352 |
| 5,653,606 | A | 8/1997 | Chrysostomou | |
| 5,951,316 | A | 9/1999 | Kawano et al. | |
| 6,447,170 | B1 | 9/2002 | Takahashi et al. | |
| 6,570,768 | B1 | 5/2003 | Medina | |
| 6,592,391 | B1 * | 7/2003 | Wu | 439/352 |
| 6,641,425 | B1 * | 11/2003 | Wu | 439/352 |
| 6,659,790 | B1 * | 12/2003 | Wu | 439/352 |
| 6,702,603 | B1 * | 3/2004 | Wu | 439/352 |
| 6,739,904 | B1 | 5/2004 | Wu | 439/497 |
| 6,746,158 | B1 | 6/2004 | Merrick | |
| 6,856,533 | B1 | 3/2005 | Wu | 439/352 |
| 6,887,091 | B1 * | 5/2005 | Wu | 439/352 |
| 7,008,253 | B1 * | 3/2006 | Szczesny | 439/352 |
| 2004/0048510 | A1 * | 3/2004 | Olson et al. | 439/381 |

OTHER PUBLICATIONS

SFF Committee (ftp.seagate.com/sff), SFF-8470 Specification for Shielded High Speed Serial Multilane Copper Connector;Rev 2.9, Sep. 9, 2003, pp. 1-51.

* cited by examiner

*Primary Examiner*—Gary F. Paumen
*Assistant Examiner*—Larisa Tsukerman

(57) ABSTRACT

A connector for electrical, telephonic and/or data transmission for selective engagement with a complementary receptacle, is provided. The connector includes a housing defining a pair of channels extending into slots at a rear surface of the housing and capable of supporting a contact member therein. The connector further includes a lanyard operatively associated with the housing. The lanyard includes locking and releasing arms slidably disposed within each channel of the housing, and an extracting tab selectively engageable with each locking and releasing arm. Additionally, the extracting tab includes a pair of legs insertable into a respective slot at the back of the housing. Each leg includes an engaging member projecting from an inner surface thereof for engaging a respective aperture formed in the slider. Desirably, the extracting tab is snap-fit connected to each locking and releasing arm.

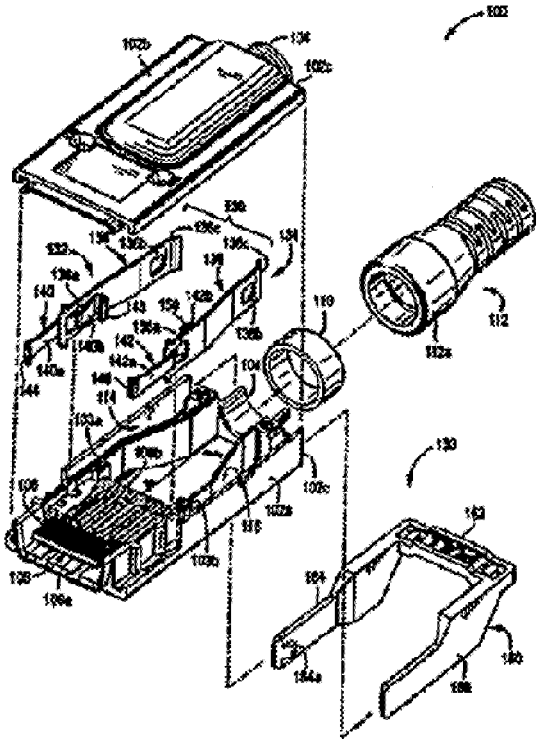

22 Claims, 5 Drawing Sheets